United States Patent [19]

Fetterman

[11] Patent Number: 4,881,564

[45] Date of Patent: Nov. 21, 1989

[54] CRUTCH TIP

[76] Inventor: Thomas Fetterman, 1122 Green St., Philadelphia, Pa. 19123

[21] Appl. No.: 111,183

[22] Filed: Oct. 22, 1987

[51] Int. Cl.[4] ..... A45B 9/04

[52] U.S. Cl. ..... 135/82; 135/84; 135/86

[58] Field of Search ..... 135/77, 82, 84, 86

[56] References Cited

U.S. PATENT DOCUMENTS

| | | | |
|---|---|---|---|
| 710,073 | 9/1902 | Pratt et al. | 135/86 |
| 755,713 | 3/1904 | Shanahan | 135/86 X |
| 960,700 | 6/1910 | Pratt | 135/86 X |
| 1,340,616 | 5/1920 | Lynde | 135/86 |
| 2,403,632 | 7/1946 | Brown | 135/86 |
| 4,135,536 | 1/1979 | Willis | 135/84 |
| 4,630,626 | 12/1986 | Urban | 135/84 |

FOREIGN PATENT DOCUMENTS

| | | | |
|---|---|---|---|
| 3508347 | 9/1986 | Fed. Rep. of Germany | 135/77 |
| 728915 | 4/1932 | France | 135/86 |
| 963349 | 12/1949 | France | 135/86 |
| 133215 | 10/1919 | United Kingdom | 135/77 |

*Primary Examiner*—Henry E. Raduazo

*Attorney, Agent, or Firm*—Panitch Schwarze Jacobs & Nadel

[57] ABSTRACT

This invention is concerned with a crutch tip including an integrally fabricated tubular receiver for a crutch shaft and having on its lower end an enlarged depending skirt. Firmly secured conformably within the skirt are a rigid plate immediately beneath the receiver, an absorption or damping pad immediately beneath the plate, and a ground engageable tread piece immediately beneath the absorption pad, which tread piece includes depending projections for receiving and flexing about small articles on the ground while maintaining traction with the ground.

7 Claims, 1 Drawing Sheet

FIG. 1
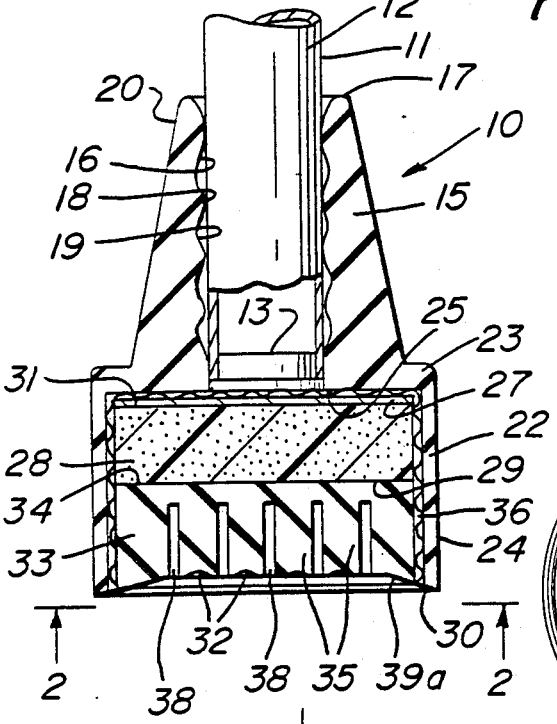
FIG. 2
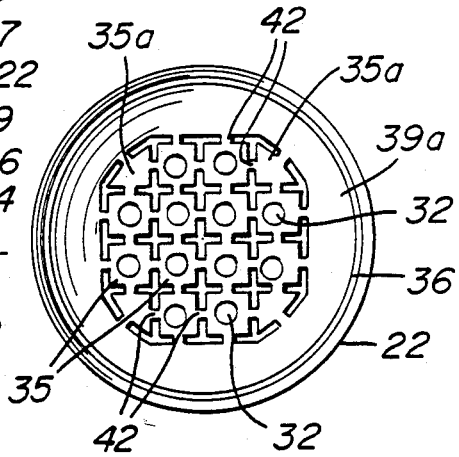
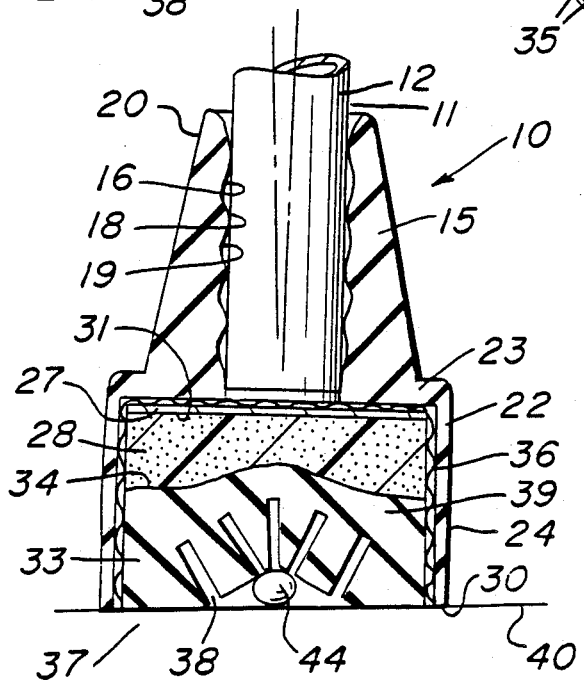
FIG. 3
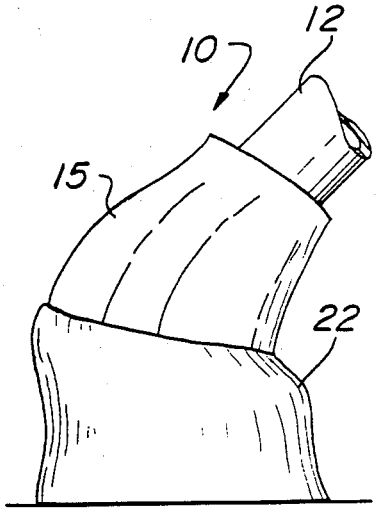
FIG. 4

CRUTCH TIP

BACKGROUND OF THE INVENTION

This invention is concerned with crutch tips, particularly shock absorbing crutch tips, and applicant is aware that the field is highly developed. However, prior shock absorbing crutch tips have not been satisfactory in use, lacking durability, being very readily subject to slipping upon engagement with small articles, such as stones, marbles, pencils, etc., and imparting undue reaction or recoil forces to the user resulting in discomfort and possible injury to active persons.

Applicant is aware of certain prior art patents, including those listed below:

| U.S. Pat. No. | Patentee |
|---|---|
| 3,251,372 | Smith |
| 3,040,757 | Smith |

The prior patents cited are subject to the disadvantages discussed above.

SUMMARY OF THE INVENTION

It is an important object of the present invention to provide a shock absorbing crutch tip which uniquely incorporates a material of high energy absorption characteristics or load damping, to greatly reduce and effectively minimize the reaction or recoil forces transmitted back to the user, for greatly enhanced comfort and effective prevention of injury.

It is another object of the present invention to provide a crutch tip of the type described wherein effective traction is maintained even under most difficult conditions, as on gravel or rollable foreign objects, and even at severely oblique or canted crutch shaft angles.

Other objects of the present invention will become apparent upon reading the following specification and referring to the accompanying drawings, which form a material part of this disclosure.

The invention accordingly consists in the features of construction, combinations of elements, and arrangements of parts, which will be exemplified in the construction hereinafter described, and of which the scope will be indicated by the appended claims.

BRIEF DESCRIPTION OF THE DRAWINGS

FIG. 1 is a longitudinal sectional view showing a crutch tip of the present invention.

FIG. 2 is a bottom end of view taken generally along the line 2—2 FIG. 1.

FIG. 3 is a longitudinal sectional view similar to FIG. 1, but illustrating an operative condition of use with the crutch shaft oblique and the crutch tip engaging a rollable object on a ground surface.

FIG. 4 is an elevation view showing the crutch tip with the crutch shaft canted at a substantial angle

DESCRIPTION OF THE PREFERRED EMBODIMENTS

Referring now more particularly to the drawings, and specifically to FIG. 1 thereof, a crutch tip is there generally designated 10, on the lower end of a crutch shaft 11. The crutch shaft 11 may be of any desired construction, say a metal tube 12 having its lower end closed by a plug 13.

The crutch tip 10 may include a generally tubular receiver or socket of elastic or rubber-like material, as at 15. The receiver 15 may have a longitudinal internal passageway or bore 16 opening upwardly, at the upper end 17 of the receiver. The bore or passageway 16 may have its internal surface of cyclically varying diameter, as by a somewhat corrugated configuration, as of internal annular lands 18 alternating with internal annular grooves 19. This assures firm frictional engagement of the receiver 15 with the received crutch shaft 12, while enabling the crutch shaft to be deliberately removed, when desired.

The exterior surface of the receiver 15 may taper upwardly, as at 20, or it may be ribbed for stiffness, if desired.

On the lower end of the receiver 15, formed integrally therewith, is an enlarged, generally cylindrical skirt 22, advantageously formed integrally with the receiver 15 and of the same rubber-like latex material. More specifically, the skirt 22 may include a circumferentially extending, radially outstanding enlargement or shoulder 23 on the lower end of the receiver 15. A generally cylindrical peripheral wall 24 extends about the enlargement or shoulder 23 and depends therefrom, the shoulder and wall defining the skirt 22.

The receiver 15 may terminate at its lower end in a generally angular, substantially flat wall 25 generally normal to and terminating radially outwardly at the peripheral skirt wall 24. The receiver bore 16 may open at its lower end through the wall 25 to communicate with the interior of the skirt 22.

A generally circular rigid member or plate 27, of approximately circular configuration is conformably engaged within the skirt 22, in facing engagement with the receiver end wall 25 and having its peripheral edge extending along the interior surface of the peripheral skirt wall 24.

A generally cylindrical pad or cushion 28 is conformably engaged within the skirt peripheral wall 24 contiguous to the underside of the plate 27 and having its underside 29 spaced above the lower edge 30 of the peripheral skirt wall 24. The cushion or shock absorption pad 28 is advantageously fabricated of a polyurethane composition which has high energy absorption characteristics to effectively damp the transmission of forces. One such material found satisfactory is that produced under the trademark VISCOLITE, but viscolastic polymer materials, or similar high shock absorption materials may be employed.

The shock absorption cushion or pad 28 may be generally cylindrical in configuration, conformably engaged in the skirt peripheral side wall 24 and may have its upper surface 31 generally flat and in congruent facing engagement with the underside of plate 27.

Occupying the space within skirt wall 24, beneath damping pad 28 is a frictional ground engaging pad or treadpiece 33, which may be generally cylindrical, having its upper surface 34 in facing engagement with the under surface 29 of the damping cushion 28. The lower surface of the treadpiece 33 may be formed with a plurality of downwardly or outwardly depending projections or fingers 35 arranged in adjacent, spaced relation with respect to each other and in a grid-like array, best seen in FIG. 2. It will there be apparent that the depending projections or fingers 35 are of generally rectangular or square cross-section, and arranged in a generally square or rectangular grid or array, with corner projections or fingers **35*a* being generally triangular. The end surfaces of the projections or fingers 35 may be concavely recessed or cupped, as at 32. The spaces between the depending fingers or projections 35 are shown as grooves or slots 38 extending inwardly from the lower or outer end surface 39***a* of the treadpiece 33 and terminating adjacent to and short of the upper end surface 34 of the treadpiece. This leaves an unslotted, generally circular portion 39 in the manner of a flexible elastic membrane, as will appear presently.

In addition, the several depending fingers or projections 35 and 35*a* may be flexibly connected together by walls or webs 42 extending across the several slots 38.

In manufacture, it has been found practical to assemble the shock absorption or damping pad 28 in sandwiched relation between the plate 27 and tread member 39, and then wrap entirely about this assembly a flexible fabric mesh or webbing 36, such as nylon, or the like. The receiver 15 and the skirt 22 are then molded about the assembled plate 27, pad 28, tread 39 and enveloping web 36, to be able to form a unitary permanently bonded structure of ample mechanical strength and effectively sealed against the penetration of liquid or moisture.

A use condition is shown in FIG. 3, wherein the crutch shaft 11 is canted at an oblique angle with respect to a ground surface 40. Notwithstanding, it will be apparent that the end surface 39*a* of the treadpiece 33 may remain in firm, frictional, facing engagement with the ground surface 40. Moreover, it is seen in FIG. 3 that a rollable article 41, say of gravel or other adverse conditions may be enveloped by depending projections or fingers 35 while the fingers remain in firm ground engagement to afford maximum safety to the user. It will be seen that the upper diaphragm portion 39 of the treadpiece 33 may be elastically deflected upwardly for accommodation to the article 41.

From the foregoing, it is seen that the present invention provides a crutch tip which is simple in construction for economy and manufacture, while affording unique functional advantages and being durable and entirely reliable throughout a long useful life.

Although the present invention has been described in some detail by way of illustration and example for purposes of clarity of understanding, it is understood that certain changes and modifications may be made within the spirit of the invention.

What is claimed is:

1. A crutch tip for installation on the lower end of a crutch shaft comprising:

an upwardly open receiver for receiving the lower end of the crutch shaft, the receiver including a lower end;

an enlarged skirt extending about and depending downwardly from the lower end of the receiver, the skirt including a shoulder with an underside extending radially outwardly from and circumferentially about the lower end of the receiver and a peripheral wall extending downwardly from the outer extremity of the shoulder;

a generally rigid plate within the skirt and extending across and secured to the lower end of the receiver and the underside of the shoulder and into engagement with the peripheral wall for receiving and spreading forces imparted by the crutch shaft;

a yieldable shock absorption pad in the skirt and extending downwardly from a lower surface of the plate;

a flexible tread piece in the skirt extending downwardly from a lower surface of the shock absorption pad, the plate, the shock absorption pad and the tread piece cooperating with the receiver and the skirt for damping and reducing reaction forces from the crutch tip to a user, the tread piece including a plurality of dependent projections for frictional engagement with a supporting surface, said receiver and said skirt being integrally fabricated of a rubber-like material to permit canting of a received crutch shaft at a substantial angle with the tread piece remaining in generally flat facing engagement with the supporting surface.

2. A crutch tip according to claim 1 said absorption pad and tread piece being substantially congruent to each other and said plate.

3. A crutch tip according to claim 1, in combination with a flexible mesh fabric circumferentially encompassing said tread piece, absorption pad and plate; and the material of said skirt being intimately bonded to said fabric, tread piece, absorption pad and plate, to define a durable unitary structure.

4. A crutch tip according to claim 1, said projections depending in spaced relation with each other and being elastic for resilient flexure in said enveloping engagement.

5. A crutch tip according to claim 4, said treadpiece comprising an elastic diaphragm and being integral with said projections for upward deflection into said shock absorption pad.

6. A crutch tip according to claim 4, in combination with webs between said projections to limit said enveloping engagement to smaller articles.

7. A crutch tip according to claim 4, said projections having their depending ends cupped for enhancing nonslip ground engagement.

* * * * *